US005169468A

United States Patent [19]

Royce et al.

[11] Patent Number: 5,169,468

[45] Date of Patent: Dec. 8, 1992

[54] ACCEPTOR SHEET FOR WAX THERMAL MASS TRANSFER PRINTING

[75] Inventors: Susan D. Royce, Norcross, Ga.; John W. Blair, Springfield, Mass.

[73] Assignee: Graphics Technology International Inc., South Hadley, Mass.

[21] Appl. No.: 554,865

[22] Filed: Jul. 20, 1990

[51] Int. Cl.[5] ..... B41M 5/26

[52] U.S. Cl. ..... 156/234; 156/277; 428/195; 428/207; 428/325; 428/327; 428/328; 428/329; 428/330; 428/331; 428/480; 428/483; 428/484; 428/488.1; 428/500; 428/913; 428/914

[58] Field of Search ..... 8/471; 428/195, 480, 428/483, 500, 913, 914, 484, 488.1, 488.4, 206, 207, 323, 325, 327-331; 503/227; 156/234, 239, 240, 277

[56] References Cited

U.S. PATENT DOCUMENTS 4,678,687 7/1987 Malhotra ..... 427/261

*Primary Examiner*—B. Hamilton Hess

*Attorney, Agent, or Firm*—Burns, Doane, Swecker & Mathis

[57] ABSTRACT

A method and composition for wax thermal mass transfer printing. A polymeric acceptor sheet for wax thermal mass transfer printing includes an image receptor layer which provides improved wax receptivity. The combination in the receptor layer of a poly(alkylvinylether) and another polymer having a higher glass transition temperature results in improved image quality by providing both good half tone images and fine line reproduction.

17 Claims, No Drawings

ACCEPTOR SHEET FOR WAX THERMAL MASS TRANSFER PRINTING

BACKGROUND OF THE INVENTION

1. Technical Field

The present invention lies in the art of thermal mass transfer printing. More specifically the invention concerns a method and composition for an acceptor sheet for wax thermal transfer printing having improved wax receptivity for better resolution and a reduced tendency to jam the printing mechanism. In particular, the invention provides for the inclusion of a poly(alkylvinylether) in the coating on the acceptor sheet, in combination with another polymer with a higher glass transition temperature and a filler.

2. Description of the Prior Art

Thermal printing involves the selective application of heat to a heat sensitive material which results in the formation of images on the material. One category of thermal printing is the donor sheet-acceptor sheet system, whereby a thermal printhead applies heat to the backside of a donor sheet in selective imagewise fashion. The images are transferred to the acceptor sheet either by chemical reaction with, or mass transfer from, the donor sheet.

Chemical reaction systems provide for the volatilization of a chemical coating on the donor sheet at locations where the donor sheet is contacted by the thermal printhead. The volatilized chemical migrates from the donor sheet to the acceptor sheet where it reacts with a chemical coating to produce a visible image on the acceptor sheet. One example of this is the volatilization of a phenol compound on the donor sheet which reacts with a leuco compound on the acceptor sheet. The leuco compound is thus converted from a colorless to a colored form and produces a visible image.

Mass transfer systems provide for the transfer of colored material directly from the donor to the acceptor sheet, with no color-forming chemical reaction occurring.

In wax thermal (mass) transfer printing, an ink or other record-forming material in admixture with a wax compound is transferred from a donor such as a carrier ribbon to an acceptor sheet by applying heat to localized areas of the carrier. The wax/ink mixture on the carrier ribbon melts or softens, preferentially adhering to the acceptor sheet, which may be either paper or transparent film. In the case of paper, the acceptor sheet has more surface roughness than does the carrier, so ink transfer is largely achieved by a physical interlocking of the softened wax and ink with the paper fibers.

The transfer of ink to an acceptor sheet film such as transparent polyester, differs in that the surface of the film is very smooth. Here, wetting of the film surface by the softened wax/ink mixture must be adequate in order to provide preferential adhesion of the wax/ink mixture to the acceptor rather than to the donor sheet. The transfer of single pixel dots is particularly sensitive to differences in adhesion because some of the heat input at the individual dot is dissipated into the surrounding ink mass, decreasing the temperature of the dot and lessening its ability to transfer.

One solution to this problem has been to incorporate wax in a coating layer placed over an acceptor sheet film substrate.

U.S. Pat. No. 4,686,549 relates to a receptor (i.e., acceptor) sheet having a wax-compatible image receptive layer which can be inter alia an ethylene/vinyl acetate copolymer blended with a paraffin wax, a microcrystalline wax or a mixture of both. The image receptive layer has a critical surface tension higher than that of the donor sheet, which aids in wetting of the image receptive layer. Furthermore, this patent teaches that the Vicat softening temperature (as measured by ASTM D1525 (1982)) of the polymers forming the image receptive layer should be at least 30° C. to prevent tackiness of the acceptor sheet at room temperature. At softening temperatures below 30° C., according patent, problems arise such as fingerprinting and blocking of stacked film.

Polymeric coatings with a 30° C. or higher softening point generally do have the advantage of minimal handling problems, as suggested by the above patent. The disadvantage is that such coatings are suitable for use only with selected combinations of printers and donor sheets. If, for example, the melting point of the wax on the donor sheet is above a specified maximum for a given printer, an insufficient amount of wax may be transferred to the acceptor sheet. Likewise, if the particular printer does not provide sufficient heat energy, the heat transfer from the donor sheet to the acceptor sheet, via the wax, may not increase the tackiness of the image receptive layer sufficiently for adhering the wax to the acceptor sheet, even if the wax does melt sufficiently for transfer. The result is inter alia poor fine line reproduction.

A number of polymeric coatings placed on the acceptor sheet have been claimed to improve ink transfer, including polyester, polycarbonate, polyamide, urea, and polyacrylonitrile resins, saturated polyester resins, stearamide, and poly(alkylvinylethers), poly(meth)acrylic esters, polymethylvinylketone, polyvinylacetate, and polyvinylbutyral.

In general, these polymeric coatings have a somewhat higher degree of adhesiveness than the transparent film substrate. This accounts for an increased receptivity of the coating as compared to the substrate. Heat transfer from the printing head to the coating increases adhesiveness even further.

Examples of this type of coating are disclosed in U.S. Pat. No. 4,678,687 which relates to thermal transfer printing sheets useful as transparencies wherein a polymeric coating is applied to a receptor substrate. The coating can be a poly(vinylether), poly(acrylic acid ester), poly(methacrylic acid ester), poly(vinylmethylketone), poly(vinylacetate) or poly(vinylbutyral). The coating allegedly provides increased resolution as compared to an uncoated substrate by increasing the adhesion of the transferred ink or dye to the receptor printing sheet. The coating composition is approximately 100% of the recited polymers.

A problem arises with these compositions when the tackiness of the coating is high enough to cause feeding problems and jamming of the printer due to adhesion either between acceptor sheets, or between the acceptor sheets and the printer rollers. High tackiness can also result in excessive wax transfer from the donor which, in the case of transfer of single pixels, results in unacceptable half tone images due to bridging of individual half tone dots. Excess tackiness also results in fingerprinting and blocking.

Hence, there remains a need in the art for an acceptor sheet which provides image formation, and particularly pixel dot image formation, of a quality sufficient for the printing of finely detailed images without loss of resolution in half tone images. There is also a need in the art for an acceptor sheet which can be used with a wider variety of printer/donor sheet combinations than has heretofore been possible and which simultaneously maintains adequate handling characteristics. These needs are met by the present invention.

SUMMARY OF THE INVENTION

It is accordingly an object of the invention to provide an acceptor sheet for wax thermal transfer printing having improved wax receptivity.

It is another object of the invention to provide an acceptor sheet, as above, which has a reduced tendency to jam the printing mechanism.

It is another object of the invention to provide an acceptor sheet, as above, which results in reduced fingerprinting and blocking.

It is still another object of the invention to provide an acceptor sheet, as above, which is particularly adapted to faithful reproduction of pixel dot image formation.

It is yet another object of the invention to provide an acceptor sheet, as above, which maintains the above characteristics yet which can be used with a wide variety of printer/donor sheet combinations.

These objects are achieved by an acceptor sheet for receiving donor material in imagewise fashion from a donor sheet by means of thermal mass transfer printing, wherein a polymeric substrate has on at least one major surface an image receptive layer providing for increased adhesion of the donor material. The image receptive layer has from about 1 to about 40 weight percent of at least one poly(alkylvinylether), and from about 0.1 to about 30 weight percent of a filler, the remainder being one or more polymers other than poly(alkylvinylether). The other polymer or polymers have a glass transition temperature (Tg) which is higher than that of the poly(alkylvinylether). The image receptive layer is capable of faithful pixel dot image formation having a high resolution and minimal fingerprinting or blocking. Further, the acceptor sheet provides for the reduction or even elimination of the occurrence of jamming in the printer.

The objects of the invention are also achieved by a method of forming an image on an acceptor sheet for thermal mass transfer printing. Heat is applied to a donor sheet in selective imagewise fashion. The donor sheet includes a substrate layer and a layer of color-containing material which is softened at selected locations on the layer due to the heat application. The color-containing material can be a dye or pigment and a wax. Suitable waxes include paraffin wax, beeswax, candalilla wax, polyethylene wax, carnauba wax, microcrystalline wax, and combinations thereof. A portion of the softened color-containing material is transferred and adhered to the acceptor sheet, thereby forming an image on the acceptor sheet. The acceptor sheet comprises a polymeric substrate having on at least one major surface thereof an image receptive layer comprising from about 1 to about 40 weight percent of at least one poly(alkylvinylether) and from about 0.1 to about 30 weight percent of a filler, the remainder being one or more polymers other than poly(alkylvinylether) with a glass transition temperature higher than that of the poly(alkylvinylether). The image receptive layer is capable of pixel dot image formation of high resolution.

In a preferred embodiment, the invention provides for an acceptor sheet wherein the image receptive layer includes poly(methylvinylether) in a minor amount, i.e., of from about 1 to about 10 weight percent, and one or more other polymers with a higher glass transition temperature in an amount of from about 85 to about 98 weight percent, and from about 0.1 to about 5 weight percent filler.

In a highly preferred embodiment, the amount of poly (methyvinylether) is about 7 percent by weight, the other polymer is a polyester in an amount of about 92 percent by weight, and the filler is silica in an amount of about 1 percent by weight.

DETAILED DESCRIPTION OF THE PREFERRED EMBODIMENTS

Many polymeric coatings, including saturated polyesters, aliphatic and aromatic polyurethanes, and polyamides form surfaces which are printable by thermal transfer. These surfaces are deficient, however, in their acceptance of single pixel dots, making them unsuitable for the printing of images with fine detail such as engineering diagrams. This deficiency is addressed by the present invention which provides for an image receptive layer containing at least one poly(alkylvinylether) in the amount of about 1 to 40 percent of the coating solids. The alkyl group of the polymer can have from 1 to 4 carbon atoms, preferably 1 to 3 carbon atoms. The glass transition temperature of the poly(alkylvinylether) is less than −30° C., preferably less than −40° C. and most preferably less than −45° C.

Poly(methylvinylether) is highly preferred due to its unusual solubility characteristics which allow its use in either aqueous or solvent-based formulations.

The coating also contains at least one other polymer having a glass transition temperature greater than −30° C., preferably greater than −20° C. and most preferably greater than −10° C. The combination of the poly(alkylvinylether) and the other polymer or polymers having a higher glass transition temperature unexpectedly provides good handling characteristics for the acceptor sheet as well as good printing characteristics. The good handling characteristics are achieved despite the fact that the Vicat softening point of the image receptive layer is below 30° C. In a preferred embodiment, the softening point, as measured by ASTM D1525(1982) (Vicat softening temperature) is less than about 23° C.

When more than one poly(alkylvinylether) and/or more than one "other" polymer is used in the image receptive layer, the Tg values for the mixture of poly(alkylvinylethers) and/or for the mixture of other polymers are generally in the range between the highest and lowest Tg values for the individual polymers in each mixture. There is, however, no formula for accurately predicting Tg values of polymer mixtures, and actual Tg values are therefore determined through direct measurement.

The softening point of the image receptive layer, although below room temperature, nevertheless results in acceptable handling characteristics of the acceptor sheet including little or no fingerprinting or blocking and a minimal tendency for jamming of the printing mechanism.

The reason for this behavior is believed to be that the "other" polymer or polymers (i.e. the non-poly(vinylalkylether)) in the image receptive layer influence the physical properties of the layer to a greater extent at ambient temperature than do the one or more poly(alkylvinylethers), while at the elevated temperatures encountered during printing, the poly(alkylvinylethers)

exert the greater influence on the wax/ink receptivity of the coating.

This results in the acceptor sheet handling with ease prior to and after the printing step. During printing, fine line reproduction is maintained at an acceptable level due to the influence of the poly(alkylvinylether). Simultaneously, half tone reproduction is acceptable due to the still significant influence of the other polymer or polymers.

Without one or more poly(alkylvinylethers) in the coating (e.g., with polyester as the sole polymer in the coating) good half tone images can generally be achieved, but fine line images are less than adequate. Use of a poly(alkylvinylether) alone gives good fine line imaging but poor half tone results, due to bridging of half tone dots. Also, the printer will jam frequently. By contrast, the combination of even a minor amount (i.e., 20% by weight or less) of poly(alkylvinylether) with a major amount of another polymer in the coating, results in good fine line reproduction without loss of half tone resolution.

This combination of printing characteristics has heretofore not been achieved, and could not be expected based on the individual properties of the polymers used in the acceptor sheet coating.

If the acceptor sheet is transparent, the image quality is further enhanced by the addition of a filler to the coating to improve the color registration as the transparency travels through the printer. The use of a filler also provides for a controllable degree of tack which can be adjusted to a desired level by varying the amount and type of filler in the formulation. A preferred filler is silica, but other materials may also be used such as titanium dioxide, calcium carbonate, clay, barium oxide, solid glass spheres, hollow glass spheres, calcium silicate, zinc oxide, aluminum oxide, barium sulfate, micronized polytetrafluoroethylene (PTFE), micronized polyethylene and the like.

The filler has a particle size ranging from about 0.01 to about 90 microns, desirably from about 0.05 to about 75 microns, and preferably from about 0.1 to about 50 microns. The amount of filler added is from about 0.1 to about 30 percent by weight, desirably from about 0.5 to about 25 percent by weight and preferably from about 1 to about 5 percent by weight.

The other polymers in the image receptive layer are selected from polyurethanes, polysulfones, polymethacrylates, polyvinylacetates, polyesters, polystyrene, polyvinylmethylketone, polylacetones, polyvinylbutyral, polyvinylchloride, polyvinylalcohol (PVOH) and combinations thereof.

The substrate for the acceptor sheet is a film comprising a polymer such as polypropylene, polycarbonate, polysulfone, polyvinylchloride, cellulose acetate, cellulose acetate butyrate, or polyester. In a preferred embodiment the film is transparent. Examples of such transparent substrates are Mylar, commercially available from E.I. DuPont de Nemours; Melinex, commercially available from Imperial Chemical Industries; Hostaphan, commercially available from American Hoechst; polycarbonates, especially Lexan; cellulose triacetates, and the like.

In general, the selection of the substrate composition is dictated by the particular use. In addition to transparent substrates, there can be used opaque or colored substrates in which one or more pigments or dyes are included in the substrate composition. One skilled in the art can readily select the appropriate substrate composition for use in the invention.

A preferred substrate is polyester with transparent polyethylene terephthalate film highly preferred in a thickness range from about 50 to about 175 microns.

In a preferred embodiment using poly(methylvinylether), the amount of this polymer is from about 1 to about 10 weight percent and the amount of the other polymer or polymers is from about 85 to about 98 weight percent, with from about 0.1 to about 5 weight percent filler.

In a highly preferred embodiment, the amount of poly(methylvinylether) is about 7 weight percent, the other polymer is a polyester in an amount of about 92 weight percent, and the filler is silica in an amount of about 1 weight percent.

A backing sheet may be applied to one side of the substrate as an aid to the printing process. This is advantageous when the acceptor sheet is used in conjunction with certain thermal transfer printers having a complicated paper feed path which places limitations on the stiffness of the substrate. The preferred substrate thickness with respect to meeting the limitations on thickness is about 50 microns. However, the printheads of certain printers are also sensitive to substrate thickness, and for printing purposes the optimum thickness is about 125 microns. This caliper would, however, be too stiff for feeding. To circumvent this problem, in a preferred embodiment the present invention provides for a backing sheet attached to the substrate via a removable adhesive strip. The backing sheet can be paper, synthetic paper such as filled biaxially oriented polypropylene, polyester film or coated polyester. Synthetic paper is preferred because of its greater dimensional stability on exposure to changes in temperature and humidity. Also, a higher coefficient of friction between the back of the acceptor sheet and the synthetic backing sheet is achieved which prevents slippage between the two films during the printing process. Slippage can result in misregistration of colors, misfeeding or jamming in the printer. In a highly preferred embodiment employing a backing sheet, a polyester substrate is used having a thickness of 50 microns with a 75 to 80 micron synthetic paper backing sheet attached via a removable adhesive strip. This embodiment of the invention can be used for preparation of transparency films for overhead projection using a Tektronix 4693D thermal transfer printer, but use is not limited to this printer. The following examples illustrate the invention. It is understood, however, that these examples are not to be interpreted as limiting the scope of the invention.

EXAMPLE 1

A solution of the following was prepared:

| | | |
|---|---|---|
| Neorez R-960 | 33% aq. aliphatic polyurethane (ICI Resins) | 30.8 g |
| Gantrez M-574 | 70% poly(methylvinylether) (30% ethanol; Tg = −35° C.) (GAF Corp.) | 3.5 g |
| HiSil T600-S | silica (PPG Ind.) | 0.10 g |
| Isopropanol | | 22.9 g |
| Water | | 42.7 g |
| | | 100.0 |

The solution was coated on a 2 mil polyester film having a suitable bonding layer with a #3 Mayer rod, then dried in a convection oven for 2 minutes at 230° F.

Coating thickness was 1-3 microns. The sheet was cut to the proper size and a 3 mil backing sheet was attached with a ⅛ in. wide adhesive strip. The sheet was then printed in a Tektronix 4693D thermal transfer printer using the "saturation dither" test mode for half tone and "alignment" test mode for fine line printing.

EXAMPLE 2

The same procedure as in Example 1 was followed except that the coating solution had the following composition:

| | | |
|---|---|---|
| Gantrez ES-225 | 50% poly(methylvinylether)/ maleic anhydride copolymer, ethyl half ester (in ethanol) (GAF Corp.) | 3.4 g |
| Lutonal M-40 | 70% poly(methylvinylether) (in toluene; Tg = −49° C.) (BASF) | 4.5 g |
| Syloid 244 × 1517 | silica (W. R. Grace) | 0.10 g |
| Isopropanol | | 92.0 g |
| | | 100.0 |

EXAMPLE 3

A coating of the following solution was prepared as in Example 1:

| | | |
|---|---|---|
| WNT Polyester | 25% aqueous dispersion (Tg = 38° C.; Eastman Kodak) | 35 g |
| Lutonal M-40 | 70% poly(methylvinylether) in toluene (BASF) | 1.4 g |
| SanSil KU-33 | silica (PPG Ind.) | 0.15 g |
| Isopropanol | | 38.45 g |
| Water | | 25 g |
| | | 100.0 |

The formulations of Examples 1-3 gave improved single pixel dot transfer when coated at a thickness of 0.1 to 5 microns on a transparent base sheet relative to a control coating which does not contain the poly(-methylvinylether).

EXAMPLE 4

The following formulation was coated on 50 micron polyester film by direct gravure and dried to give a coating thickness of less than 2 1 microns.

| | | Supplier |
|---|---|---|
| Ethanol | 37.38% by weight | |
| Water | 24.76 | |
| WNT polyester | 36.52 | Eastman |
| Lutonal M-40 | 1.19 | BASF |
| Sansil KU-33 | 0.15 | PPG |
| | 100.00 | |

EXAMPLE 5

A coating was prepared in the same manner as in Example 4 except that the formulation used was:

| | |
|---|---|
| Ethanol | 36.94% by weight |
| Water | 24.63 |
| WNT polyester | 37.32 |
| Lutonal M-40 | 0.96 |
| Sansil KU-33 | 0.15 |
| | 100.00 |

EXAMPLE 6

A coating was prepared in the same manner as in Example 4 except that the formulation used was:

| | |
|---|---|
| Ethanol | 36.69% by weight |
| Water | 24.46 |
| WNT polyester | 38.00 |
| Lutonal M-40 | 0.70 |
| Sansil KU-33 | 0.15 |
| | 100.00 |

A 75-80 micron polypropylene backing sheet (Kimdura 80) was attached to the coated polyester films of Examples 4, 5 and 6 with ⅛ in. wide high tack/low tack tape on the short axis. Samples of these constructions were imaged with Tektronix 4693D thermal transfer printer. Formulations 5 and 6 gave the best image quality, with formulation 5 being preferred.

EXAMPLE 7

A coating of the following solution was prepared and tested as in Example 1:

| | | Supplier |
|---|---|---|
| Ethanol | 35.86% by weight | |
| Water | 23.91 | |
| AQ38D polyester (25% in water; Tg = 38° C.) | 36.23 | Eastman |
| Lutonal M-40 (70% in toluene) | 0.93 | BASF |
| Poly(styrene sulfonic acid) (20% in water) | 2.91 | |
| Sansil KU-33 silica | 0.15 | PPG |
| | 100.00 | |

This example shows the use of a conductive polymer, poly(styrene sulfonic acid) to provide antistatic properties to the coating.

Examples 8 and 9 are comparative examples using polyester and polymethylvinyl ether, respectively, as the sole polymer in the coating.

EXAMPLE 8

(Comparative Example)

| | | Supplier |
|---|---|---|
| Lutonal M-40 poly(methylvinylether) 70% in toluene | 14.29% by weight | BASF |
| Ethanol | 85.56 | |
| Sansil KU-33 silica | 0.15 | PPG |
| | 100.0 | |

The above solution was coated on two mil polyester film with a 3 Mayer rod and dried for two minutes at 230° F. A 3 mil backing sheet was attached with a tape strip on the short axis of an 8½×11 in. sample. The same was printed on the Tektronix 5693D printer. Half tone reproduction was poor due to severe bridging of half tone dots. Fine line reproduction was good but the coating was very tacky to the touch, and jammed frequently in the printer.

EXAMPLE 9

(Comparative Example)

| | | Supplier |
|---|---|---|
| AQ38D polyester resin (25% in water) | 40.0% by weight | Eastman |
| Ethanol | 59.85 | |
| Sansil KU-33 silica | 0.15 | PPG |
| | 100.00 | |

Coatings were prepared a in Example 8 and printed in the 5693D printer.

Good half tone images were prepared with little bridging of half tone dots. Fine line reproduction was poor.

EXAMPLE 10

A coating of the following solution was prepared and tested as in Example 1:

| | |
|---|---|
| Deionized Water | 24.63% by weight |
| Ethanol | 36.94 |
| AQ38D | 37.32 |
| Lutonal I-30 | 00.67 |
| Toluene | 00.29 |
| Sansil KU-33 | 00.15 |
| | 100.0 |

EXAMPLE 11

A coating of the following solution was prepared and tested as in Example 1:

| | |
|---|---|
| Deionized Water | 24.63% by weight |
| Ethanol | 36.94 |
| AQ38D | 37.32 |
| Lutonal A-50 | 00.96 |
| Sansil KU-33 | 00.15 |
| | 100.0 |

EXAMPLE 12

(Comparative Example)

A coating was prepared in accordance with Example 1 of U.S. Pat. No. 4,686,549 except that a 2 mil polyester film was coated and a Kimdura 80 backing sheet was attached with tape before printing on the Tektronix 4693D printer.

| | |
|---|---|
| Elvax 310 | 10% by weight |
| HistowaxHX0482-5 | 10 |
| Toluene | 80 |
| | 100 |

On printing, the coating was found to have poor image acceptance for both halftones and fine line reproduction as well as poor wax transfer from the donor ribbon.

The TABLE summarizes the properties of half tone resolution and fine line reproduction for Examples 1-2.

TABLE

| Comparative Print Quality Results | | |
|---|---|---|
| Example No. | Half tone Resolution | Fine Line Reproduction |
| 1 | 3 | 3 |
| 2 | 3 | 3 |
| 3 | 3 | 4 |
| 4 | 4 | 4 |
| 5 | 5 | 5 |
| 6 | 5 | 4 |
| 7 | 5 | 4 |
| 8 | 1 | 5 |
| 9 | 5 | 1 |
| 10 | 5 | 4 |
| 11 | 5 | 4 |
| 12 | 1 | 1 |

1 = worst
5 = best

The surface coatings described herein for film can also be used to enhance the transfer of ink to other surfaces, such as paper, textiles, etc.

Other additives such as antistatics, dyes, pigments, optical brighteners and the like may also be incorporated when desired.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An acceptor sheet for receiving donor material in imagewise fashion from a donor sheet by means of thermal mass transfer printing, comprising a polymeric substrate having on at least one major surface thereof an image receptive layer comprising from about 1 to about 40 weight percent of at least one poly(alkylvinylether), and from about 0.1 to about 30 weight, percent of a filler, the remainder consisting essentially of a polyester having a glass transition temperature higher than that of the poly(alkylvinylether), the image receptive layer being capable of pixel dot image formation having high resolution.

2. An acceptor sheet according to claim 1, wherein the alkyl group of the poly(alkylvinylether) has from 1 to 4 carbon atoms.

3. An acceptor sheet according to claim 2, wherein the poly(alkylvinylether) is poly(methylvinylether).

4. An acceptor sheet according to claim 1, wherein the polyester is an amorphous, water-dispersible, ionically substituted resin.

5. An acceptor sheet according to claim 1, wherein the glass transition temperature of the poly(alkylvinylether) is less than about −30° C.

6. An acceptor sheet according to claim 1, wherein the filler is selected from the group consisting of silica, titanium dioxide, calcium carbonate, clay, barium oxide, solid glass spheres and hollow glass spheres, calcium silicate, zinc oxide, aluminum oxide, barium sulfate, micronized polytetrafluoroethylene, micronized polyethylene, and combinations thereof.

7. An acceptor sheet according to claim 6, wherein the filler has a particle size of from about 0.01 to about 90 microns.

8. An acceptor sheet according to claim 6, wherein the filler has a particle size of from about 0.05 to about 75 microns.

9. An acceptor sheet according to claim 6, wherein the filler has a particle size of from about 0.1 to about 50 microns.

10. An acceptor sheet according to claim 1, wherein the poly(alkylvinylether) is poly(methylvinylether) in an amount of from about 1 to about 10 weight percent and silica in an amount of from about 1 to about 5 weight percent, the remainder being a polyester resin.

11. An acceptor sheet according to claim 1, wherein the poly(alkylvinylether) is poly(methylvinylether) in an amount of about 7 percent by weight, the polyester resin is present in an amount of about 92 percent by weight and the filler is silica in an amount of about 1 percent by weight.

12. An acceptor sheet according to claim 1, wherein the substrate comprises polyethylene terephthalate.

13. An acceptor sheet according to claim 1, including a backing sheet attached to the substrate on a major surface thereof.

14. An acceptor sheet according to claim 13, wherein the backing sheet comprises paper or a synthetic polymer selected from the group consisting of polypropylene, polyester, polyethylene and combinations thereof.

15. A method of forming an image on an acceptor sheet for thermal mass transfer printing, comprising the steps of:

applying heat to a donor sheet in selective imagewise fashion, the donor sheet including a substrate layer and a layer of color-containing material, the color-containing material being softened at selected locations on the layer due to said heat application; and transferring and adhering at least a portion of the softened color-containing material to the acceptor sheet, thereby forming an image on the acceptor sheet;

wherein the acceptor sheet comprises a polymeric substrate having on at least one major surface thereof an image receptive layer comprising from about 1 to about 40 weight percent on at least one poly(alkylvinylether) and from about 0.1 to about 30 weight percent of a filler, the remainder consisting essentially of a polyester having a glass transition temperature higher than that of the poly(alkylvinylether), the image receptive layer being capable of pixel dot image formation having high resolution.

16. A method as claimed in claim 15, wherein the color-containing material comprises a dye or pigment and a wax.

17. A method as claimed in claim 16, wherein the wax is selected from the group consisting of paraffin wax, beeswax, candalilla wax, polyethylene wax, carnauba wax, microcrystalline wax, and combinations thereof.

* * * * *